US005732417A

United States Patent [19]

Pondelick et al.

[11] Patent Number: 5,732,417

[45] Date of Patent: Mar. 31, 1998

[54] VACCUM TOILET SYSTEM

[75] Inventors: Mark A. Pondelick, Brodhead, Wis.; William P. Mulligan, Holland, Mich.; Morris J. Brunell, Rockton, Ill.

[73] Assignee: Envirovac Inc., Rockford, Ill.

[21] Appl. No.: 615,441

[22] Filed: Mar. 12, 1996

[51] Int. Cl.[6] ..... E03D 11/00

[52] U.S. Cl. ..... 4/427; 4/431

[58] Field of Search ..... 4/305, 427, 431–435

[56] References Cited

U.S. PATENT DOCUMENTS

| | | | |
|---|---|---|---|
| 1,164,882 | 12/1915 | Sommer | 4/305 X |
| 3,239,847 | 3/1966 | Parri | 4/305 X |
| 3,965,492 | 6/1976 | Hendricks | 4/422 |
| 4,041,557 | 8/1977 | Ringler . | |
| 4,136,823 | 1/1979 | Kullberg . | |
| 4,195,374 | 4/1980 | Morris et al. . | |
| 4,204,285 | 5/1980 | Pak . | |
| 4,258,444 | 3/1981 | Orszullok . | |
| 4,521,925 | 6/1985 | Chen et al. . | |
| 4,531,939 | 7/1985 | Izumi | 4/305 X |
| 4,552,331 | 11/1985 | Smart, Jr. . | |
| 4,802,246 | 2/1989 | Laverty, Jr. . | |
| 4,891,864 | 1/1990 | Laverty, Jr. | 4/427 X |
| 5,007,117 | 4/1991 | Oldfelt et al. . | |
| 5,214,807 | 6/1993 | Terve . | |
| 5,495,626 | 3/1996 | Lindroos et al. | 4/435 |

FOREIGN PATENT DOCUMENTS

| | | | |
|---|---|---|---|
| 2615014 | 11/1988 | France | 4/305 |

*Primary Examiner*—Charles E. Phillips
*Attorney, Agent, or Firm*—Smith-Hill and Bedell

[57] ABSTRACT

A vacuum toilet system is protected against overflow of a toilet bowl by an overflow protection system that automatically generates an overflow condition signal when the toilet bowl is in a near-full condition and initiates a discharge valve operating cycle, in which the discharge valve of the toilet bowl is opened and closed independently of the flush member associated with the toilet bowl, in response to the overflow condition signal.

8 Claims, 1 Drawing Sheet

VACCUM TOILET SYSTEM

BACKGROUND OF THE INVENTION

This invention relates to a vacuum toilet system.

A conventional vacuum toilet system, for example of the kind installed in a passenger transport aircraft, comprises several toilet bowls each having an outlet that is connected through a normally closed discharge valve to a vacuum sewer pipe. The sewer pipe is in communication with the suction side of a blower that exhausts to the exterior of the aircraft. The blower operates under control of a blower controller, which is disabled when the aircraft is at an altitude above about 15,000 feet. There are several rinse jets distributed about the rim of the toilet bowl, and the rinse jets are connected to the aircraft's potable water supply through a normally closed rinse water supply valve. A flush control unit controls operation of the discharge valve and the rinse water supply valve. When a flush control switch associated with the toilet bowl is momentarily closed, typically by actuating a flush lever, the flush control unit receives a flush switch signal and, in response thereto, executes a flush cycle in which the discharge valve is opened and closed and the rinse water supply valve is opened and closed. In addition, the flush control unit activates the blower controller if the aircraft is below about 15,000 feet and the blower produces a substantial partial vacuum (e.g. 0.3 to 0.5 bar below ambient pressure) in the vacuum sewer pipe. At an altitude above 15,000 feet, the blower is not needed to create partial vacuum in the vacuum sewer pipe, and accordingly the blower controller is not activated. When the discharge valve is opened, the contents of the toilet bowl are forced into the vacuum sewer pipe due to pressure difference between the interior space of the toilet bowl and the interior space of the vacuum sewer pipe. When the rinse water supply valve is opened, rinse water is supplied to the toilet bowl by way of the rinse jets for rinsing the interior surface of the toilet bowl.

The rinse water supply valve may be a single-acting, spring-loaded, solenoid-actuated valve, and there is a possibility that the rinse water supply valve will remain in the open position after completion of the flush cycle so that water continues to be supplied to the toilet bowl after the discharge valve has closed. This eventuality causes a risk of overflowing the toilet bowl and flooding, as well as possibly draining the potable water tank.

SUMMARY OF THE INVENTION

In accordance with the invention there is provided a vacuum toilet system comprising a toilet bowl having an outlet, a discharge valve connecting the outlet of the toilet bowl to a vacuum sewer pipe, and an overflow protection system including a means for generating an overflow condition signal when the toilet bowl is in a near-full condition, and an overflow controller responsive to the overflow condition signal for initiating a discharge valve operating cycle, in which the discharge valve is opened and closed.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
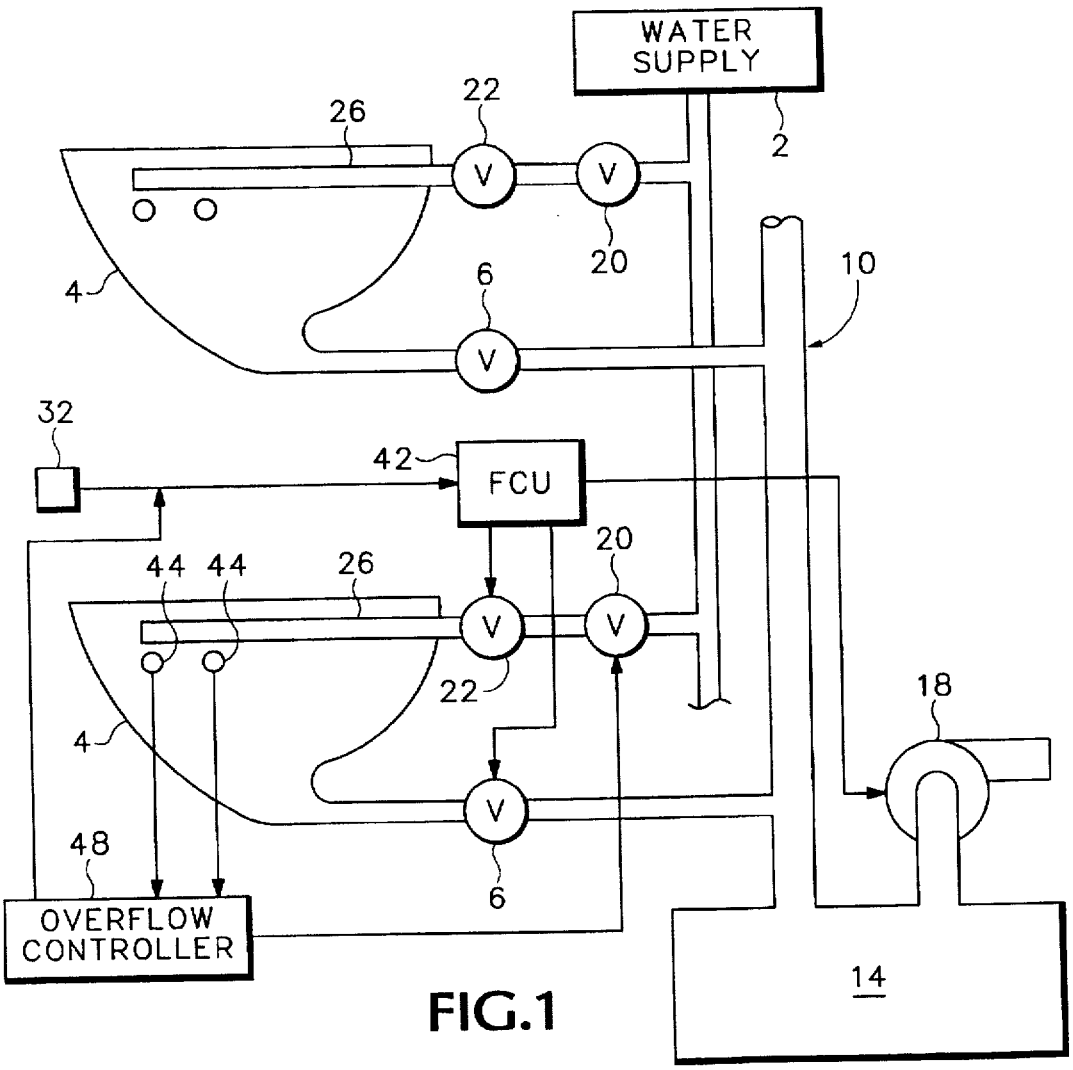
FIG. 1 is a schematic block diagram illustrating a vacuum toilet system in accordance with the present invention.
Figure 2:
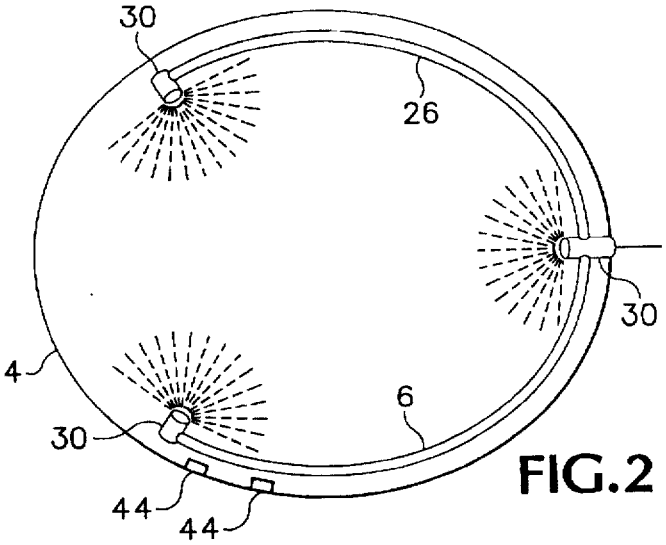
FIG. 2 is an enlarged top plan view of one of the toilet bowls shown in FIG. 1.

The vacuum toilet system that is shown in FIG. 1 is installed in a passenger aircraft that includes a source 2 of potable water under pressure. The toilet system comprises several toilet bowls 4. Each toilet bowl has its outlet connected to one side of a normally closed, motor driven discharge valve 6, the other side of which is connected through a vacuum sewer pipe 10 to a sewage collecting tank 14. At an altitude above about 15,000 feet, the sewage collecting tank and the vacuum sewer pipe are under ambient pressure. A blower 18 is provided for producing a substantial partial vacuum (e.g. 0.3 to 0.5 bar below ambient) in the sewage collecting tank and the vacuum sewer pipe at lower altitudes. The water source 2 is connected through a normally open, motor-driven isolation valve 20 and a normally closed, solenoid-operated rinse water supply valve 22 to a spray ring 26, which is accommodated in the toilet bowl beneath an internal flange (not shown) at the top of the toilet bowl. The spray ring is connected to several rinse jets 30 that are distributed around the rim of the toilet bowl. A flush lever is provided for each of the toilet bowls. However, only one flush lever, designated 34, is shown in FIG. 1. When the flush lever 34 is pressed, it temporarily closes (renders conductive) a flush switch (not shown), which supplies a flush switch signal or flush command to a flush control unit 42 to initiate a flush cycle. During the flush cycle, the flush control unit issues control signals to open and close the discharge valve and to open the rinse water supply valve against the force of a return spring. At an altitude below about 15,000 feet, the flush control unit also issues a control signal to the blower controller to operate the blower 18. When the control signal for the rinse water supply valve is removed, the solenoid is de-energized and will normally close under the force of the return spring and water pressure.

Although it is possible that the rinse water supply valve will be jammed in the open position, or that the discharge valve will be jammed in the closed position, it is extremely unlikely that both these events will occur at the same time. Accordingly, it is possible to guard against overflow of the toilet bowl by opening the discharge valve whenever the toilet bowl is determined to be in a near overflow condition. In order to detect that the toilet bowl is in a near overflow condition, the toilet bowl 4 is provided with two electrodes or probes 44 that are installed through the wall of the toilet bowl near the rim and are exposed at the interior surface of the toilet bowl. The two electrodes are connected to an overflow controller 48, which monitors the electrical resistance between the electrodes.

During normal operation of the vacuum toilet system, the resistance between the two electrodes is well above 60,000 ohms, even when rinse water is being sprayed from the rinse jets. On the other hand, if the toilet bowl were full of water, the resistance between the two electrodes would fall to below 60,000 ohms and would remain below 60,000 ohms as long as the two electrodes remained below the free surface of the water.

When the resistance between the two electrodes remains below 60,000 ohms for at least three seconds, the overflow controller executes an overflow protection cycle, which commences at time t=0. At time t=0, the overflow controller initiates a flush sequence by supplying a flush switch signal to the flush control unit, just as if the flush lever had been pressed, and the flush control unit executes a normal flush cycle. The discharge valve opens and water in the toilet bowl is forced into the sewer pipe. In this manner, overflowing of the toilet bowl is prevented.

Execution of the flush cycle does not protect against the potable water system being drained. Therefore, immediately after supplying the flush switch signal to the flush control unit, and as part of the flush sequence, the overflow controller provides a signal to close the isolation valve. Typically, this signal closes a switch connecting the drive motor for the isolation valve to a suitable source of electrical energy. The isolation valve interrupts the supply of rinse water to the rinse jets independently of the rinse water supply valve.

There is a possibility that a quantity of water will remain in the toilet bowl, particularly if the vacuum in the sewer pipe is lower than normal (the pressure in the sewer pipe is higher than normal, e.g. 0.8 bar abs.). Therefore, after the initial flush sequence has been completed, the overflow controller executes a re-flush sequence, in which it generates a second flush switch signal. In this manner, residual water in the toilet bowl is removed.

The overflow controller is not disabled when it has executed an overflow protection cycle. Therefore, if the isolation valve should malfunction, such that it does not fully close, protection against overflow is assured because the overflow protection cycle, comprising the flush and re-flush sequences, is executed each time the continuity limit between the electrodes is reached. The overflow controller causes excess water in the toilet bowl to be removed regardless of whether action has previously been taken to interrupt supply of water to the toilet bowl.

It is important that the overflow controller should not open the isolation valve automatically after the overflow protection cycle has been completed, since if the rinse water supply valve remained jammed in the open position, this could lead to the potable water system being drained by repeatedly filling the toilet bowl and discharging its contents into the sewage collecting tank.

Although the isolation valve is electrically driven, the overflow controller is configured so that the isolation valve is not opened electrically by the overflow controller but is on the contrary opened manually by service personnel during servicing of the aircraft. This ensures that the occurrence of the malfunction comes to the attention of service personnel so that the rinse water supply valve can be repaired or replaced.

It will be appreciated that the invention is not restricted to the particular embodiment that has been described, and that variations may be made therein without departing from the scope of the invention as defined in the appended claims and equivalents thereof. For example, the invention is not restricted to the case in which the isolation valve can only be opened manually and the overflow controller may instead be provided with a switch for resetting the isolation valve.

We claim:

1. A vacuum toilet system comprising:

a toilet bowl having an outlet, a discharge valve connecting the outlet of the toilet bowl to a vacuum sewer pipe, and an overflow protection system including a means for generating an overflow condition signal when the toilet bowl is in a near-full condition, and an overflow controller responsive to the overflow condition signal for initiating a discharge valve operating cycle, in which the discharge valve is opened and closed.

2. A vacuum toilet system according to claim 1, further comprising a rinse water valve connecting a source of rinse water to a rinse water outlet in the toilet bowl, and wherein the overflow protection system includes an isolation valve responsive to the overflow controller for interrupting supply of water to the rinse water outlet independently of the rinse water supply valve.

3. A vacuum toilet system according to claim 2, wherein the isolation valve is connected between the rinse water supply valve and the source of rinse water.

4. A vacuum toilet system according to claim 2, further comprising a flush control unit that is responsive to a flush command to execute a flush cycle, in which energy is supplied to the discharge valve and the rinse water supply valve for opening and closing the respective valves, and the overflow controller is responsive to the overflow condition signal to issue a flush command to the flush control unit.

5. A vacuum toilet system according to claim 4, wherein the overflow controller is responsive to the overflow condition signal to issue a first flush command to the flush control unit and to issue a second flush command to the flush control unit after a predetermined time has elapsed following issue of the first flush command.

6. A vacuum toilet system according to claim 1, wherein the toilet bowl has a rim and an interior surface and the means for generating an overflow condition signal comprises two electrodes exposed at the interior surface of the toilet bowl, at least one of the electrodes being near the rim of the bowl such that in the event that the toilet bowl is filled with water up to a level above the two electrodes, the electrodes are electrically connected by the water in the toilet bowl.

7. A vacuum toilet system according to claim 1, further comprising a flush control unit that is responsive to a flush command to execute a flush cycle, in which energy is supplied to the discharge valve for opening and closing the discharge valve, and the overflow controller is responsive to the overflow condition signal to issue a flush command to the flush control unit.

8. A vacuum toilet system according to claim 7, wherein the overflow controller is responsive to the overflow condition signal to issue a first flush command to the flush control unit and to issue a second flush command to the flush control unit after a predetermined time has elapsed following issue of the first flush command.

* * * * *